United States Patent [19]

Asai

[11] Patent Number: 4,746,304

[45] Date of Patent: May 24, 1988

[54] CONNECTION APPARATUS FOR CONNECTING ELECTRICAL DEVICES

[75] Inventor: Naoki Asai, Nagano, Japan

[73] Assignee: Seiko Epson Kabushiki Kaisha, Tokyo, Japan

[21] Appl. No.: 858,624

[22] Filed: May 2, 1986

[30] Foreign Application Priority Data

May 10, 1985 [JP] Japan ..... 60-68864[U]
May 10, 1985 [JP] Japan ..... 60-99366

[51] Int. Cl.[4] ..... H01R 13/629; H01R 13/64

[52] U.S. Cl. ..... 439/248; 439/296; 439/372

[58] Field of Search ..... 339/64 R, 64 M, 75 R, 339/75 M, 82; 439/246–252, 296, 310, 345, 372

[56] References Cited

U.S. PATENT DOCUMENTS

| | | | |
|---|---|---|---|
| 2,871,457 | 1/1959 | Jencks et al. | 339/64 M |
| 2,954,543 | 9/1960 | Rayer et al. | 339/64 M |
| 2,984,814 | 5/1961 | Scott | 339/64 M |
| 2,988,414 | 6/1961 | Crowe et al. | 339/64 R |
| 3,434,096 | 3/1969 | Pusateri, Jr. | 339/75 R |
| 3,673,545 | 6/1972 | Rundle | 339/64 M |
| 3,701,083 | 10/1972 | Ziegler, Jr. | 339/64 M |
| 4,032,207 | 6/1977 | Ericson et al. | 339/75 M |
| 4,569,565 | 2/1986 | Golder | 339/64 R |

*Primary Examiner*—Gil Weidenfeld
*Assistant Examiner*—Gary F. Paumen
*Attorney, Agent, or Firm*—Blum Kaplan

[57] ABSTRACT

A connection apparatus for connecting a first face of a first electrical device to a second face of a second electrical device. First and second hooks are coupled in spaced relation to the first face of the first electrical device. A pivot member, in facing relation to the first hook, is coupled to the second face of the second electrical device for releasably engaging with the first hook. The second electrical device is pivotable about the engagement of the first hook and the pivot member between a proximate position where the second hook is proximate to the second face of the second electrical device and a spaced position where the second hook is spaced apart from the second face of the second electrical device. A locking apparatus is displaceably mounted on the second face of the second electrical device for releasably engaging with the second hook in a first position and disengaging with the second hook in a second position. The movement of the locking apparatus from the second position to the first position when the first hook and pivot members are engaged serves to hold the electrical devices together.

36 Claims, 5 Drawing Sheets

CONNECTION APPARATUS FOR CONNECTING ELECTRICAL DEVICES

BACKGROUND OF THE INVENTION

The invention is generally directed to an apparatus for connecting two electrical devices and also for connecting the electrical connectors on the electrical devices and in particular to a connecting apparatus which releasably locks two electrical devices together and which assures a good electrical contact between the electrical connectors on the two devices.

Traditionally, host computers are connected to printers with junction cables or using plug and socket connectors (male and female connectors) to form a computer system with the two devices. The plug and socket connectors are selectively coupled to the printer and host computers with respective shell portions fixed in place by connectors such as screws which insure a stationary fit. Alternatively, the plug and socket connectors are selectively coupled to arm-like or pedestal-shaped portions of the printer and host computers.

However, the traditionally used cable connectors are insufficient when used in conjuction with portable and miniaturized computer systems having computers and printers and to accommodate computer systems with a variety of needs. The cable connectors tend to take up space and prevent close contact of the host computer and printer. In addition, attaching or detaching the connector and printer or host computer is particularly difficult. Manually attaching the connectors often results in the possibility of a detective connection between the electrical contacts on the connectors.

In particular, connections using junction cables are not well suited to portable and miniaturized computer systems utilizing a host computer and printer. It is noted that the host computer may include a variety of memory devices such as a floppy disk or hard disk drive or other memory device. When utilizing plug and socket connectors, it is critical that they be accurately positioned so as to achieve a complete connection between each of the electrical contacts on the connector. If the plug and socket connectors are improperly connected, the normal flow of signals transmitted between the host computer and the printer cannot flow. Further, the computer system is defective in appearance because the respective adjacent front and rear surfaces of a printer and a computer, especially in a portable computer system, are dislocated from each other.

Accordingly, there is a need for an improved connection apparatus for connecting two electrical devices such as a host computer and a printer which are adapted to be portable which allows for the connection of these devices at close quarters to aid in portability and miniaturization of the computer system while assuring that electric connections made by use of plug and socket connectors connect the electrical contacts on the plug and socket connectors for reliable operation of the computer system.

SUMMARY OF THE INVENTION

The invention is generally directed to a connection apparatus for connecting a first face of a first electrical device to a second face of a second electrical device. First and second hooks are coupled to opposite ends of the first face of the first electrical device and provide a biasing force. A pivot member coupled to a first end of the second face of the second electrical device is adapted to releasably engage with the first hook. The second electrical device is pivotable about the engagement of the first hook and the pivot member from a proximate position, where the second hook is proximate to the opposite end of the second face of the second electrical device, to a spaced position, where the second hook is spaced apart from the opposite end of the second face of the second electrical device.

A locking member on the opposite end of the second face of the second electrical device is adapted to releasably engage with the second hook. The locking member has a first member for engaging with the second hook in a first position and disengaging with the second hook in a second position. The locking member also includes a latching member operatively coupled to the first member for moving the first member between the first and second positions. The movement of the first member from the first position to the second position by the latching member when the first hook and pivot member are engaged in the proximate position causes the first and second electrical devices to be biased together by the first and second hooks and locked together. The movement of the first member from the second position to the first position allows rotation of the second electrical device from the proximate position to the spaced position for releasing the connection between the first and second electrical devices.

Accordingly, it is an object of the invention to provide an improved connection apparatus for connecting two electrical devices.

It is another object of the invention to provide an improved connection apparatus for connecting a first face of a first electrical device to a second face of a second electrical device.

A further object of the invention is to provide an improved connection apparatus for connecting a host computer to a printer.

Still another object of the invention is to provide an improved connection apparatus for connecting a printer and a host computer without using cables between the devices to provide an improved miniaturized computer system including a host computer and printer.

Yet another object of the invention is to provide an improved apparatus for connecting a first electrical connector in a first electrical device and a second electrical connector in a second electrical device to operatively electrically couple the two electrical devices.

Yet a further object of the invention is to provide a connecting apparatus for connecting the electrical connectors on a host computer and a printer to insure reliable connection between the electrical contacts on the corresponding electrical connectors.

Still a further object of the invention is to provide an improved apparatus for connecting electrical connectors on two electrical devices by making one of the connectors laterally slidable with respect to the other electrical connector.

Still another object of the invention is to provide a connecting apparatus which is adaptable to small and portable devices because the connecting portions are covered by the respective printer and computer cases.

Still other objects and advantages of the invention will in part be obvious and will in part be apparent from the specification.

The invention accordingly comprises the fectures of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
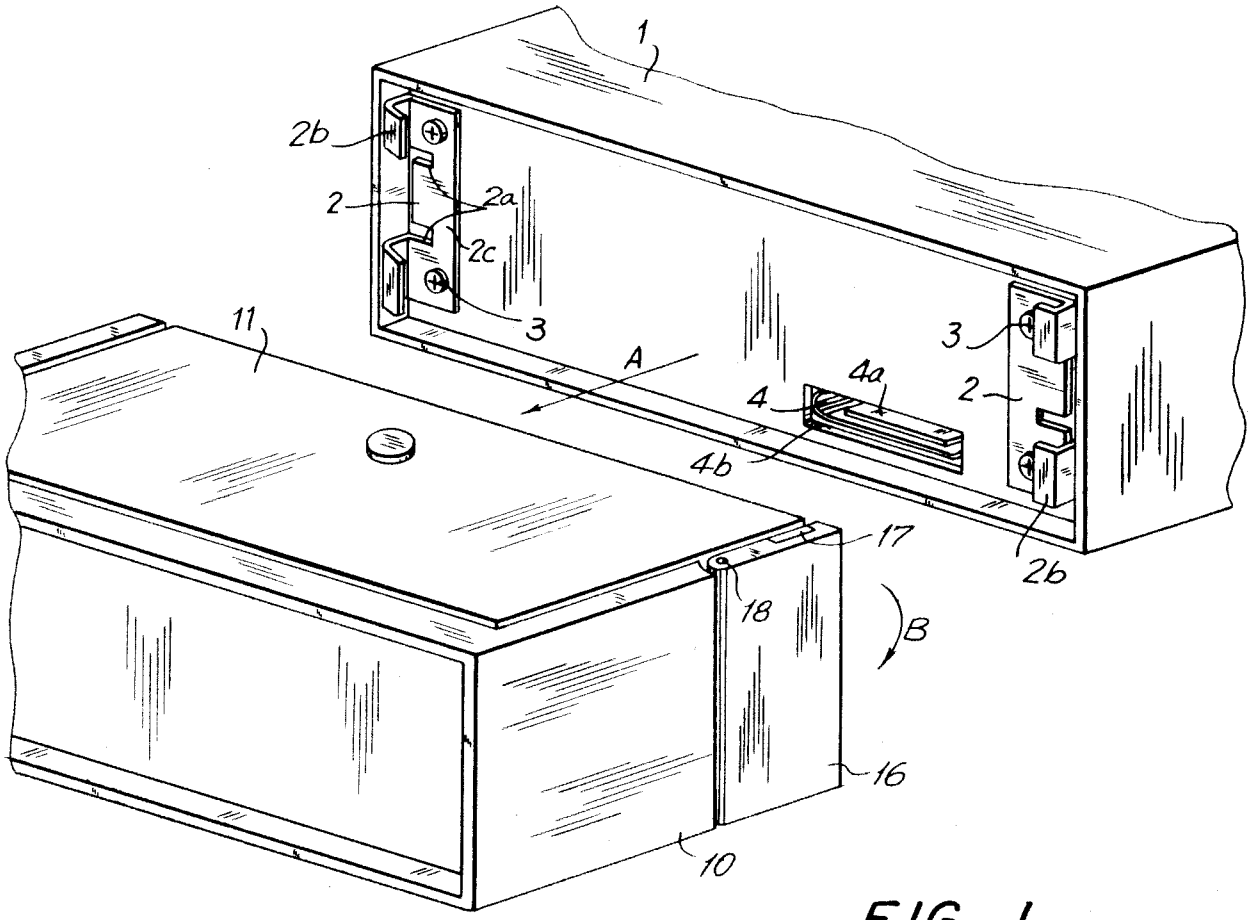
FIG. 1 is a perspective fragmentary view of a spaced computer and a printer showing a connection apparatus constructed in accordance with a preferred embodiment of the invention.
Figure 2:
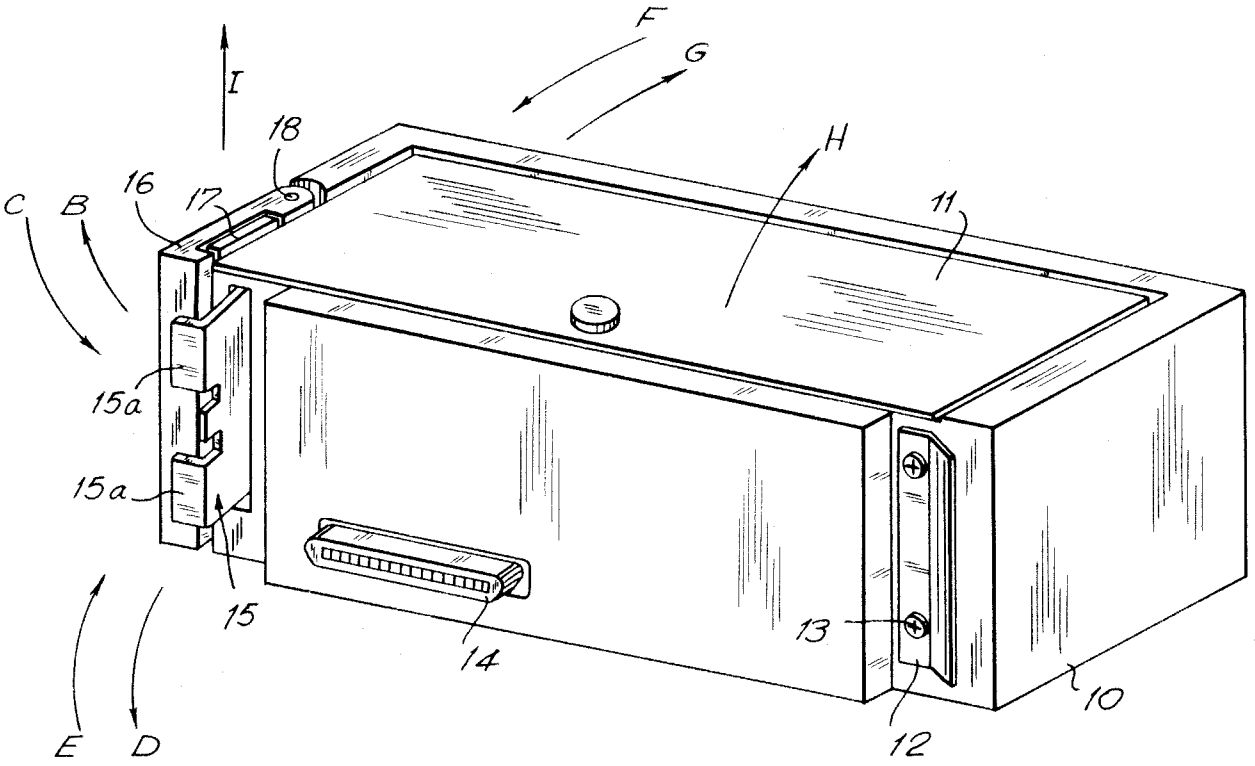
FIG. 2 is a perspective view of the printer of FIG. 1 seen from the direction of arrow A in FIG. 1.

Reference is first made to FIGS. 1 and 2 wherein the connection apparatus for connecting a host computer 1 (which has its rear face shown in FIG. 1), and a printer 10 is depicted. Computer 1 includes a keyboard, a display device, a memory device and other common features as well as a computing device such as a microprocessor (not shown).

Computer 1 has two hook springs 2 for connecting computer 1 with printer 10. Each hook spring 2 is formed with two cut-out regions **2*a* in essentially flat mounting portion 2*c* which each define the inner boundary of one of a pair of spaced, U-shaped hook portions 2*b* formed integrally with mounting portion 2*c*. As more particularly shown in FIG. 3, each hook portion 2*b* has a first leg 2*d* defining an angle with mounting portion 2*c* and a base 2*e* joining legs 2*d* and 2*f*. Legs 2*d* and 2*f* diverge in opposed directions from base 2*e*. Hook portions 2*a* are shaped so as to exert a biasing force on pivot plate 12 and latch plate 15 supported on printer 10 to pull computer 1 and printer 10 together when hook portions 2*a* interlock with the said pivot plate 12 and latch 15 as more particularly described below. A hook spring 2 is fixed at each end of the rear of computer 1 by screws 3. The two hook springs 2** may be of the same size and shape.

Printer 10 has a top lid 11 which can be opened in the direction of arrow H (FIG. 2). With printer lid 11 open, a latch handle 17 used to ensure that computer 1 and printer 10 are locked together, may be pivotably displaced in the direction of arrow I (FIGS. 2 and 7) as more particularly described in more detail below, unlocking the connector apparatus.

When latch handle 17 acts to lock lock plate 16 in the position shown in FIGS. 2 and 7, as more particularly described below, and top lid 11 is closed, the printer has a substantially flat top surface without projecting portions so that an extremely portable and convenient system is provided.

Computer 1 has a substantially rectangular hole **4*b* at its rear. A shell connector 4 is located within hole 4*b* so as to enclose a card edge portion 4*a* of a connecting substrate. A plug connector 14 is located at the corresponding position on the front of printer 10 so as to be, when the connection apparatus hold computer 1 and printer 10 together, securely connected to shell connector 4, when so positioned, the electrical contacts in plug connector 14 are adapted to engage the electrical contacts on card edge portion 4*a* electrically coupling computer 1 and printer 10. Shell connector 4 and plug connector 14** may be standard female and male connectors which are commonly used or any other type of connecting set.

Figure 5:
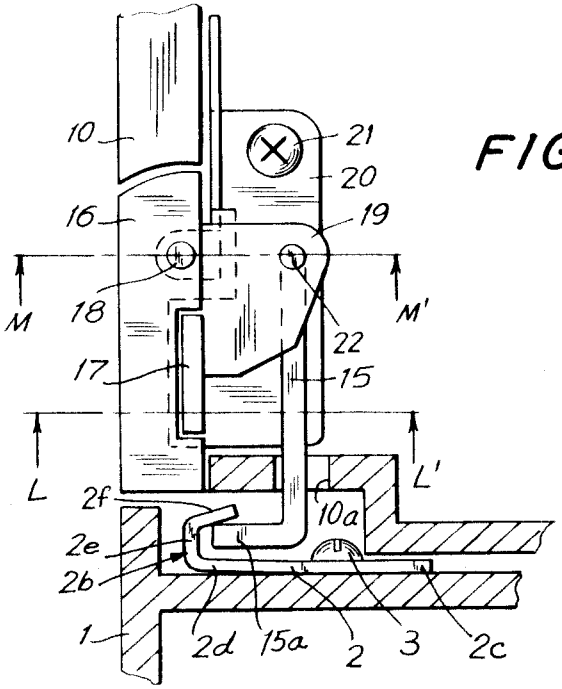
FIG. 5 is a fragmentary top plan view similar to FIG. 4 and further including a portion of the host computer and showing the engagement between the latch plate on the printer and the hook spring on the host computer.
Figure 4:
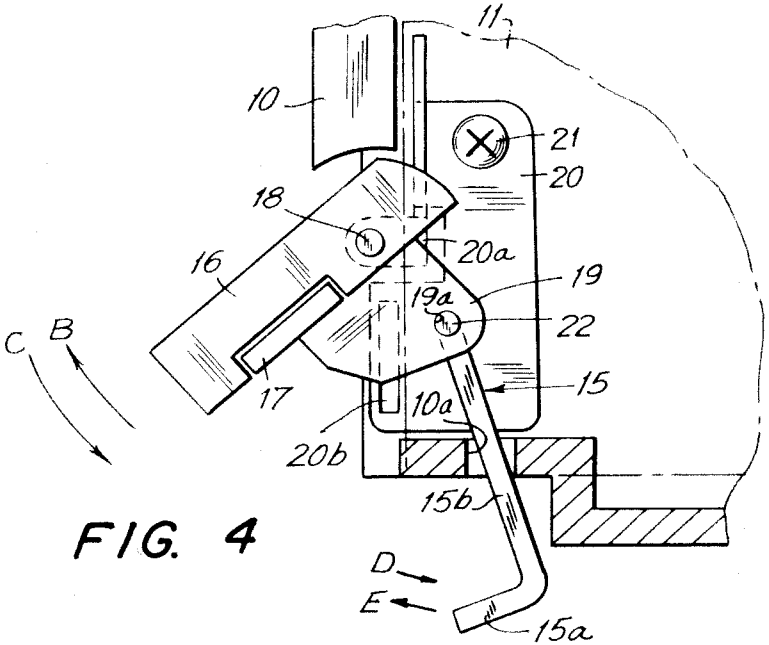
FIG. 4 is a fragmentary top elevational, partially sectioned view of the printer, with the top removed showing the operation of the latch plate and lock plate.

A lock plate 16 is pivotably mounted on a fulcrum axis 18, at a rear edge thereof, adjacent a front corner of a side panel of printer 10. As seen in FIGS. 4 and 5, a lock plate 16 supports a pair of latch plate holders 19 projecting toward the interior of printer 10. Each latch plate holder 19 is formed with a hole **19*a* therethrough adapted to receive a laterally projecting extension 22 of a latch plate 15. Latch plate 15 is pivotably mounted on latch plate holders 19, and therefore on lock plate 16. Latch plate 15 is essentially L-shaped, the short leg thereof being defined by a pair of spaced hook portions 15*a*, extending extensions 22 projecting laterally from the end of the long leg 16*b*** thereof.

Figure 6:
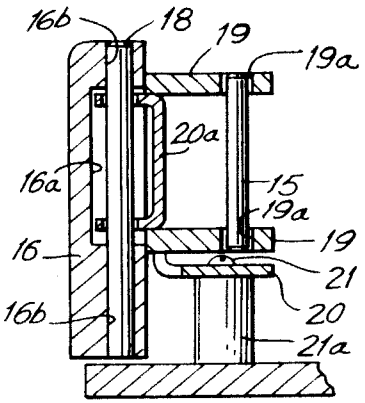
FIG. 6 is a cross sectional view taken along line M—M' of FIG. 5.

A latch frame 20 is fixed in spaced relation to the bottom of printer 10 by a screw 21 and spacer **21*a*. Latch frame 20 has a generally U-shaped fulcrum supporting portion 20*a* for supporting fulcrum axis 18 (FIG. 6) in a manner which allows rotation of fulcrum axis 18 relative to supporting portion 20*a*. Supporting portion 20*a* is received in a cavity 16*a* in lock plate 16 and is formed with holes 20*b* therethrough for receiving fulcrum axis 18. Fulcrum axis 18 is a shaft which is fitted in bores 16*b* extending vertically through portions of lock plate 16 in registration with cavity 16*a***, by means of a press fit or other method.

When computer 1 is connected to printer 10, lock plate 16 is closed in the direction of arrow C (FIG. 4). Lock plate 16 can be displaced by hand. The effect of rotating lock plate 16 in the direction of arrow C is to rotate latch plate 15 in the opposite direction, that is in the direction of arrow E (FIG. 4). This results from the fact that the long arm **15*b* of latch 15 extends through a guide opening 10*a* in the wall of printer 10, to define a pivot point for latch plate 15**.

When it is desired to separate host computer 1 from printer 10, the locking connection between lower hook portion **15*a* of latch plate 15 and hook portions 2*b* of hook spring 2 is released by rotating lock plate 16 outwardly from the position depicted in FIG. 5 in the direction of arrow B to the position depicted in FIG. 4. This has the effect of rotating latch plate 15 in the direction of arrow D away from hook portion 2*b* of spring 2. In this position host computer 1 and printer 10 can be easily separated. The rotation of latch plate 15 is restricted by the width of guide opening 10*a* in printer 10 (FIGS. 4, 5). Upper and lower hook portions 15*a* of latch plate 15 are designed to engage with upper and lower hook portions 2b of hook spring 2 in the position shown in FIG. 5. In the position shown in FIG. 4, there is no engagement and printer 10 can be separated from host computer 1**.

Figure 3:
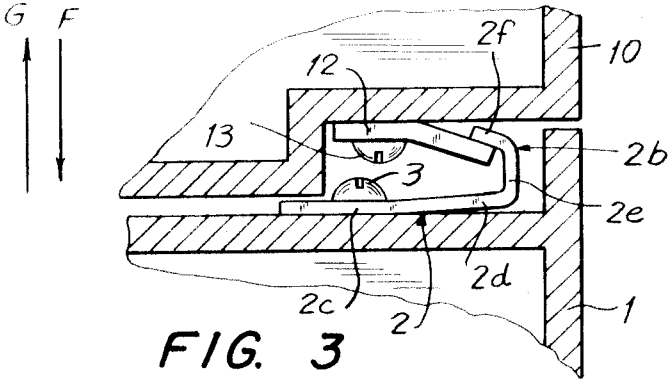
FIG. 3 is a fragmentary cross sectional view of the connected computer and printer showing a hook spring coupled to the host computer and a pivot plate coupled to the printer.

To assemble printer 10 and computer 1, the first step is to engage pivot plate 12, which is coupled to printer 10 by a screw 13, with spring hook 2, which is coupled to printer 1 by screw 3. FIG. 3 shows the arrangement of pivot plate 12 and spring hook 2 in a proximate position where hook spring 2 on the other end of computer 1 is engaged by latch plate 15 (as shown in FIG. 5). However, in attaching host computer 1 to printer 10, pivot plate 12 is first engaged with spring hook 2 at a position with the printer 10 rotated in the direction of arrow G about the axis defined by the engagement of pivot plate 12 and spring hook 2 from the position shown in FIG. 3. In this spaced position, latch plate 15 cannot engage with spring hook 2 on the other end of host computer 1 (FIGS. 1, 5). After pivot plate 12 engages with spring hook 2 in the spaced position, printer 10 is rotated in the direction of arrow F (FIG. 3) to the proximate position shown in FIG. 3 in which latch plate 15 can engage spring hook 2 on the end of host computer 1.

When the printer 10 is pivoted to the proximate position so that spring hook 2 is close enough to printer 10 so that hook portion 15a of latch plate 15 may engage hook portion 2b of spring hook 2, latch plate 16, which is in the position shown in FIG. 4 is manually pushed in the direction of arrow C until it reaches the position shown in FIG. 5 with hook portion 15a of latch plate 15 and hook portion 2b of spring hook 2 in locking engagement. As lock plate 16 is moved from the position shown in FIG. 4 to the position shown in FIG. 5, printer 10 is pulled toward computer 1 by the movement of latch plate 15 to interengage hook portions 15a of latch plate 15 with the inclined surfaces of legs 2f of hook portions 2b of one spring hook 2 and to interengage the inclined surface 12a of pivot plate 12 with the inclined surface of hook portions 2b of the other spring hook 2.

Printer 10, rather than computer 1 moves as computer 1 is generally heavier than printer 10. However, if this weight ratio is shifted so that printer 10 is heavier than computer 1, computer 1 would move relative to printer 10 without affecting the manner in which the connection is formed. As a result of this operation a firm connection between computer 1 and printer 10, with freedom of movement between the two devices limited by the biasing force exerted by hook spring 2, is effected.

In the embodiment shown in FIGS. 1 and 2, computer 1 is electrically connected to printer 10 with the card edge portion 4a inserted into plug connector 14 while hook portions 2b and 15a are locked together. Since the initial engagement of pivot plate 12 and the associated spring hook 2 defines a positional relationship between the printer 10 and computer 1, card edge portion 4a is in registration with plug connector 14 as printer 10 is pivoted from the spaced to the proximate position. Thus, when lock plate 16 is pushed to its closed position shown in FIG. 5, a firm electrical connection between host computer 1 and printer 10 is smoothly achieved without the use of any excessive force and without twisting connectors 4a, 14. Computer 1 is also smoothly released from printer 10 when the two devices are separated by lock plate 16 rotating from the position shown in FIG. 5 to the position shown in FIG. 4 (that is in the direction of arrow B). As lock plate 16 is moved in this manner hook portion 15a of latch plate 15 contacts against leg 2d of hook portion 2b of hook spring 2 to force printer 10 and computer 1 apart and to smoothly separate the connection between plug connector 14 and card edge portion 4a. The separation is completed by pivoting printer 10 relative to computer 1 in the direction of arrow F (FIG. 3).

Figure 7:
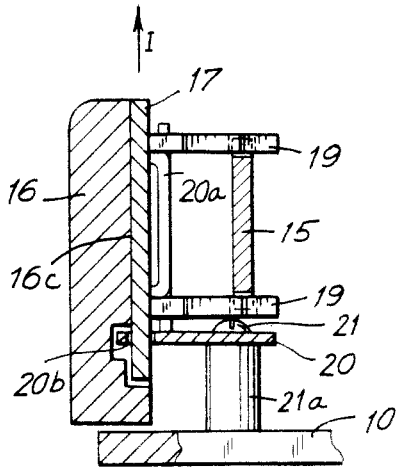
FIGS. 7 and 8 are cross sectional views taken along line L—L' of FIG. 5 showing the locked and released states of the lock plate respectively.
Figure 8:
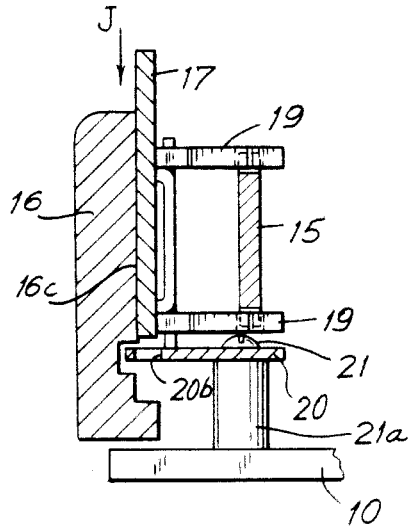

Reference is next made to FIGS. 7 and 8 wherein the manner in which latch handle 17 operates to lock and unlock the movement of latch plate 15, by restricting the movement of lock plate 16 is depicted. Latch handle 17 is redily accessible when top 11 of printer 10 is rotated upwardly. Latch handle 17 is slidably guided by a guide surface 16c of lock plate 16. Latch handle 17 is slidable upwardly (in the direction of arrow I in FIG. 7), and downwardly (in the direction of arrow J in FIG. 8). In this manner, latch handle 17 is movable from a locking position, shown in FIG. 7 where latch handle 17 is inserted in a hole 20b formed in latch frame 20, to prevent angular movement of lock plate 16, to an unlocked position as shown in FIG. 8 where latch handle 17 is free of hole 20b, thereby allowing free angular movement of lock plate 16 as described above. Latch handle 17 provides further assurance that computer 1 and printer 10 are securely locked to each other and are easily separated when such separation is desired. With top 11 of printer 10 down, coputer 1 and printer 10 are securely located together.

Figure 9:
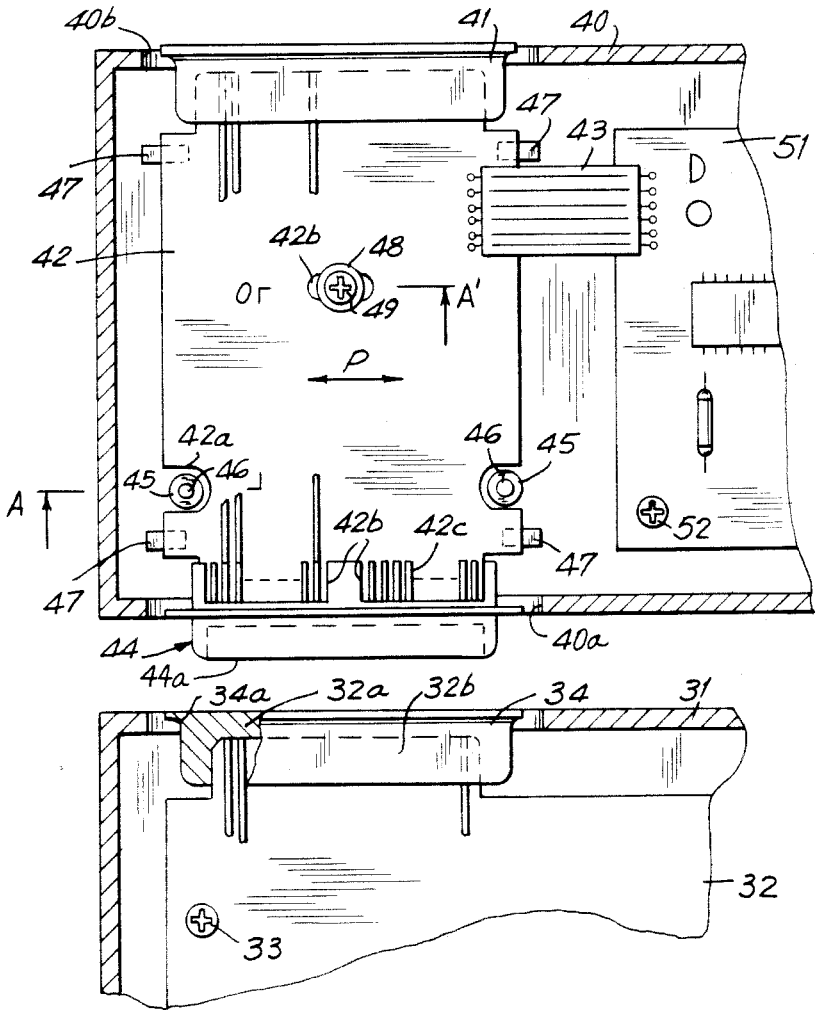
FIG. 9 is a partially cut away top plan view showing a connection structure for connecting the electrical contacts for a host computer and printer in accordance with another embodiment of the invention.
Figure 10:
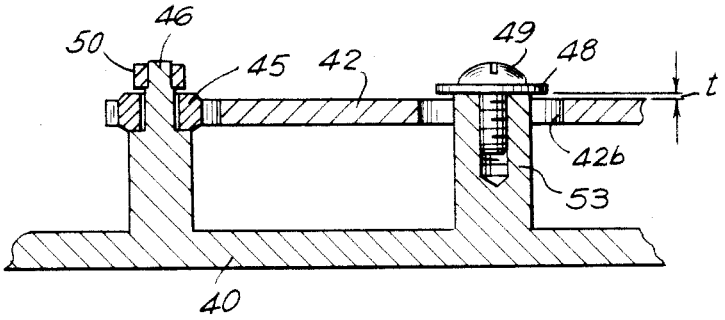
FIG. 10 is a cross sectional view taken along the line AOA' of FIG. 9.

In addition to connecting two electrical devices such as a printer and a computer it is desired to also assure an accurate connection between the electrical connectors on the devices. Reference is next made to FIGS. 9 and 10 wherein an apparatus for assuring an accurate connection of two electrical connectors on electrical devices adapted to be connected is shown. FIG. 9 is a top plan view showing the connection between a computer generally indicated as 31 and a printer, generally indicated as 40.

Computer 31 has a substrate 32 with circuit elements formed or mounted thereon, including lead contacts 32a for transmitting signals. Substrate 32 is installed in a fixed manner to the body of printer 31 by screw or screws 33. Substrate 32 has a card edge portion 32b which supports the ends of lead contacts 32a and is adapted to be connected to the corresponding connector of printer 40. Card edge portion 32b is protected and secured by a shell connector 34 having a generally tapered shape at the portion adapted to receive a connector 44 of printer 40 for guiding the connector of printer 40. An end guide portion 34a is arc-shaped, resulting in a lateral force being applied to a connector portion adapted to engage with card edge portion 32a which is not properly centered with respect to card edge portion 32a and shell connector 34.

Printer 40 includes a first connector substrate 42 and a second fixed substrate 51. Fixed substrate 51 is securely coupled to the body of printer 40 by fixing screw or screws 52. Connector substrate 42, which is coupled to printer 40 in a more complicated manner, has side recesses 42a and elliptical screw hole 42b. Printer 40 has, integrally formed with the case thereof roller shafts 46 adapted to be received in recesses 42a on the left and right sides of connector substrate 42. A guide roller 45 is disposed on each roller shaft 46 so as to be rotatable thereon. Connector substrate 42 is formed with projections 42b bearing lead contacts 42c and projects into and supports a connector 44 having lead contacts in cavity 44*a* which are electrically coupled to lead contacts 42*c* in a conventional manner. Connector substrate 42 is moved laterally in the direction of arrow P in response to lateral pressure exerted on connector 44 by shell connector 34 during coupling.

Connector substrate 42 is also mounted on supporting guides 47 which are adapted to allow substrate 42 to slide laterally with respect thereto. As shown, connector substrate 42 has its movement controlled by two guide rollers 45 which engage with recesses 42*a* of substrate 42. Two recesses 42*a* and guide rollers 45 are shown although it is possible for there to be additional guide rollers 45 and recesses 42*a* to control the lateral movement of substrate 42. When guide rollers 45 are located at the extreme left and right of connector substrate 42, minimization of movement caused by looseness between guide rollers 45 and recesses 42*a* and between roller shafts 46 and guide rollers 45 is achieved. Control substrate 51 is connected to connector substrate 42 by a flexible cable 43 which allows reliable transmission of signals between substrate 51 and substrate 42 even when there is movement of substrate 42 in the direction of arrow P.

Connector substrate 42 is fixed to the body of printer 40 by a fixing screw 49 received in spacer post 53. A small space t between the bottom of a flat washer 48 and the top surface of substrate 42 is present to prevent binding of substrate 42 against washer 48 (FIG. 10). As seen in FIG. 9, fixing screw 49 is inserted in elliptical hole 42*b* so that connector substrate 42 can move laterally.

A projecting portion 42*d* bearing lead contacts 42*c* projects from the opposite side of connector substrate 42 for use in connecting other electrical devices to the rear of connector substrate 42 in the same way as a connection to computer 31 and shell connector 34 is made to connector 44. A connector 41 is supported by projecting portion 42*d* and is positioned in an opening 40*b* in the case of printer 40. Openings 40*a* and 40*b* in the case of printer 40 are dimensioned to permit lateral displacement of the assembled connector substrate 42 and connectors 44 and 41. Additional electrical devices with similar connecting structures can be integrally coupled with computer 31 and printer 40 forming a chain of electronic devices linked together, front to back.

A pressure bushing 50 (FIG. 10) is pressed on each roller shaft 46 to insure that guide roller 45 does not slip upward on roller shaft 46 and disengage from connector substrate 42. Instead of bushing 50, other conventional approaches such as using a retaining ring may be utilized.

The electrical connection between the host computer 31 and printer 40 can be created by aligning connectors 34 and 44 and then moving computer 31 and printer 40 together. As connector 44 is forced into connector 34, any misalignment of connector 44 is corrected by the lateral force applied to it by end guide portion 34*a* of connector 34 which moves substrate 42 laterally in the direction of arrow P to insure a proper electrical fit. Alternatively, the connection can be made by placing the opposed corners of computer 31 and printer 40 shown at the left of FIG. 9 together and angularly rotated the other opposed corners together. In either case, the connection is achieved by providing a force in the direction of arrow P as described above. In both of these connecting processes, the connector substrate 42 of printer 40 is moved so as to adjust its position for providing a reliable electrical connection between the connectors.

Accordingly, an apparatus for connecting a computer 1 and printer 10 is shown and described. Computer 1 and printer 10 are easily connected by engaging pivot plate 12 of printer 10 with hook spring 2 of computer 1. Then, printer 10 is pivoted about pivot plate 12 to a proximate position where the other hook spring 2 and latch plate 15 can engage. Lock plate 16 is then closed creating a locked connection. The solid connection is maintained due to the biasing force created by hook spring 2. In addition, with latch handle 17 pushed down in its locking position, lock plate 16 is prevented from rotating and separation of the devices which may be caused by a vibration, falling down or other traumatic events is prevented, and as a result, the portability of the computer system is increased. In addition, printer 10 and computer 1 can be easily separated by pulling latch handle 17 to its opened position and opening lock plate 16. With printer 10 and computer 1 coupled together by the connecting apparatus a small and portable computer system is created since lock plate 16 is locked flat at one of the corners of printer 10.

In addition, at least one element of the connection between the connecting device on a computer and the connecting device on the printer is laterally movable, so that an accurate electrical connection, is provided. The printer connector is laterally movable by roller shafts fixed to the bottom of the printer. When a dislocation of the lateral alignments of the substrate in the computer and the substrate in the printer is present, the dislocation is corrected by moving the movable connector substrate in a lateral direction so that no defective connection results.

Since the connector substrates are connected directly to each other the present invention provides a connecting device for securely and accurately combining a computer and a printer into a compact and portable system of high reliability and pleasing appearance.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A connection apparatus for connecting a first face of a first electrical device to a second face of a second electrical device and electrically connecting the first and second devices, comprising:

first and second hook means coupled in spaced relation to the first face of the first electrical device;

pivot means in facing relation to the first hook means coupled to the second face of the second electrical device for releasably engaging with said first hook means, said second electrical device being pivotable about the engagement of the first hook means and the pivot means between a proximate position where the second hook means is proximate the second face of the second electrical device and a spaced position where the second hook means is spaced apart from the second face of the second electrical device;

locking means displaceably mounted on said second face of the second electrical device for releasably engaging with said second hook means when said locking means is in a first position and said second electrical device is in said proximate position, and disengaging with said second hook means when said locking means is in a second position;

the second electrical device having a second connector with electrical contacts and a shell connector with a camming surface;

the first electrical device having a first connector including a substrate having electrical contacts for coupling with the second connector; and means for moving the substrate relative to the second connector so that the electrical contacts on the second connector and substrate align and provide an electrical connection between the first and second electrical devices;

whereby the movement of the locking means from the second position to the first position when the first hook means and pivot means are engaged serves to hold the electrical devices together and form an electrical connection between them.

2. The connection apparatus of claim 1 wherein the electrical connector on the first electrical device is laterally displaceable with respect to the electrical connector on the second electrical device and with respect to the first electrical device to insure alignment of the first and second electrical connectors.

3. The connection apparatus of claim 1 wherein the pivot means includes a pivot plate having a connecting surface for coupling to the second face of the second electrical device and an inclined surface at an angle to said first surface for engaging said first hook means.

4. The connection apparatus of claim 1 wherein each of the first and second hook means has a first portion for coupling with said first face of the first electrical device and a second portion for engaging said pivot means and said locking means, respectively.

5. The connection apparatus of claim 4 wherein the second portion of each hook means has an inclined face adapted to bias said first and second electrical devices together when the electrical devices are held together.

6. The connecting device of claim 4 wherein the second portion of the hook means includes two U-shaped arms extending outwardly from the first portion.

7. The connection apparatus of claim 4 wherein the first and second hook means are formed of a resilient material.

8. The connection apparatus of claim 4 wherein the hook means are coupled to opposite ends of the first face.

9. The connection apparatus of claim 1 wherein the locking means include latch means for engaging with said second hook means and lock means operatively coupled to said latch means for moving said latch means between a first engaging position with said second hook means and a second disengaging position where said latch means is disengaged from said second hook means.

10. The connection apparatus of claim 9 wherein the lock means is pivotably connected to said second electrical device.

11. The connection apparatus of claim 9 further comprising a connection member for operatively coupling the latch means and the lock means wherein the connection member is fixed to said lock means and pivotably coupled to said latch means.

12. The connection apparatus of claim 10 further comprising a connection member for operatively coupling the latch means and the lock means wherein the connection member is fixed to said lock means and pivotably coupled to said latch means.

13. The connection apparatus of claim 12 where rotation of the lock means in one direction results in rotation of the latch means in an opposite direction.

14. The connection apparatus of claim 9 wherein the lock means forms a corner of the second face of the second electrical device in the engaging position.

15. The connection apparatus of claim 9 wherein the latch means includes an arm section and an engaging section at an angle to the arm section.

16. The connection apparatus of claim 15 wherein the arm section extends through an opening in the second face of said second electrical device and the size of said opening limits the range of movement of the arm and engaging sections.

17. The connection apparatus of claim 1 further comprising disabling means operatively coupled to said locking means for selectively preventing movement of said locking means from said first position to said second position.

18. The connection apparatus of claim 17 wherein the disabling means includes a latch handle adapted to lock said locking means in a disabling position and to free said locking means to move between the first and second positions in an enabling position.

19. The connection apparatus of claim 2 wherein the pivot means includes a pivot plate having a connecting surface for coupling to the second face of the second electrical device and an inclined surface at an angle to said first surface for engaging said first hook means.

20. The connection apparatus of claim 2 wherein each of the first and second hook means has a first portion for coupling with said first face of the first electrical device and a second portion for engaging said pivot means and said locking means, respectively.

21. The connection apparatus of claim 2 wherein the locking means include latch means for engaging with said second hook means and lock means operatively coupled to said latch means for moving said latch means between a first engaging position with said second hook means and a second disengaging position where said latch means is disengaged from said second hook means.

22. The connection apparatus of claim 21 wherein the lock means is pivotably connected to said second electrical device.

23. The connection apparatus of claim 22 further comprising a connection member for operatively coupling the latch means and the lock means wherein the connection member is fixed to said lock means and pivotably coupled to said latch means.

24. The connection apparatus of claim 21 wherein the latch means includes an arm section and an engaging section at an angle to the arm section.

25. The connection apparatus of claim 2 further comprising disabling means operatively coupled to said locking means for selectively preventing movement of said locking means from said first position to said second position.

26. The connection apparatus of claim 2 wherein the electrical connectors on the first and second electrical devices are pulled together when the locking means engages the second hook means.

27. The connection apparatus of claim 1 wherein the means for moving said substrate includes connector means coupled to said substrate and adapted to engage with said shell connector and movement means for allowing motion of said substrate in the direction lateral to the connection between the first and second electrical devices.

28. The connection apparatus of claim 27 wherein the substrate includes at least two recesses and said movement means includes roller shafts coupled to said first electrical device adapted to be received within each of said recesses and guide rollers associated with and rotatably mounted on each of said roller shafts for engaging said substrate at said recesses to allow lateral movement of the substrate relative to the first electrical device.

29. The connection apparatus of claim 27 wherein the connector means includes a tapered connector adapted to be received within the shell connector and which transmits a lateral force to the substrate when the tapered connector is inserted in the shell connector in a misaligned position laterally moving the substrate to an aligned position.

30. The connection apparatus of claim 29 wherein the substrate includes at least two recesses and said movement means includes roller shafts coupled to said first electrical device adapted to be received within each of said recesses and guide rollers associated with and rotatably mounted on each of said roller shafts for engaging said substrate at said recesses to allow lateral movement of the substrate relative to the first electrical device.

31. The connection apparatus of claim 1 wherein the substrate is slidably supported on supporting guides adapted to allow lateral movement of the substrate relative to the first electrical device.

32. The connection apparatus of claim 1 wherein the substrate has an opening therein and the substrate is coupled to the first electrical device by a connector extending through said opening, said opening being configured to allow lateral movement of the substrate relative to the first electrical device.

33. A connector for electrically connecting a first electrical device to a second electrical device having a second connector with electrical contacts for transmitting electrical signals between the first and second electrical devices and a shell connector with a camming surface, the first electrical device connector comprising: a substrate having electrical contacts for coupling with the connector on the second electrical device; and means for moving said substrate relative to the second connector in said second electrical device so that the electrical contacts on the second connector and substrate align providing an electrical connection between said first and second electrical devices, wherein the means for moving said substrate includes connector means coupled to said substrate and adapted to engage with said shell connector and movement means for allowing motion of said substrate in the direction lateral to the connection between the first and second electrical devices, and the substrate further includes at least two recesses and said movement means includes roller shafts coupled to said first electrical device adapted to be received within each of said recesses and guide rollers associated with and rotatably mounted on each of said roller shafts for engaging said substrate at said recesses to allow lateral movement of the substrate relative to the first electrical device.

34. The connector of claim 33 wherein the connector means includes a tapered connector adapted to be received within the shell connector and which transmits a lateral force to the substrate when the tapered connector is inserted in the shell connector in a misaligned position laterally moving the substrate to an aligned position.

35. The connector of claim 33 wherein the substrate is slidably supported on supporting guides adapted to allow lateral movement of the substrate relative to the first electrical device.

36. The connector of claim 33 wherein the substrate has an opening therein and the substrate is coupled to the first electrical device by a connector extending through said opening, said opening being configured to allow lateral movement of the substrate relative to the first electrical device.

* * * * *